United States Patent [19]

Glushko et al.

[11] 4,244,172

[45] Jan. 13, 1981

[54] FLATTENED STRAND ROPE

[76] Inventors: Mikhail F. Glushko, prospekt Shevchenko, 15/5, kv. 17; Viktor K. Skalatsky, ulitsa Zhukovskogo, 5, kv. 25; Anatoly I. Zakrzhevsky, prospekt Shevchenko, 8a, kv. 28; Anatoly D. Zakhryamin, ulitsa Yaroslavskogo, 45, kv. 14, all of Odessa, U.S.S.R.

[21] Appl. No.: 9,268

[22] Filed: Feb. 2, 1979

[51] Int. Cl.[3] ..... D07B 1/22; D07B 5/10

[52] U.S. Cl. ..... 57/215; 57/219

[58] Field of Search ..... 57/200, 212, 213, 214, 57/215, 219, 138, 10

[56] References Cited

U.S. PATENT DOCUMENTS

| | | | |
|---|---|---|---|
| 975,541 | 11/1910 | Leschen | 57/215 X |
| 3,035,403 | 5/1962 | Grimes et al. | 57/215 X |
| 3,083,817 | 4/1963 | Campbell | 57/138 X |
| 3,128,799 | 4/1964 | Kerr | 57/138 X |
| 3,364,289 | 1/1968 | Campbell | 57/219 X |
| 3,831,370 | 8/1974 | Gilmore | 57/219 |

*Primary Examiner*—Donald Watkins

*Attorney, Agent, or Firm*—J. Harold Nissen

[57] ABSTRACT

The flattened strand rope of the invention comprises wedge-shaped strands, each made up of wires wound on a core. At least a portion of the strand wires are fashioned as twisted wire groups in which the wires are sector-shaped and in contact with each other over helical surfaces. With such a structural embodiment of the flattened strand wire, use can be made of thin and, consequently, stronger and more flexible wires, thereby increasing the strength and flexibility of the rope and making for the use of the rope in the various branches of industry, including lifting mechanisms with large or small drum diameters.

15 Claims, 8 Drawing Figures

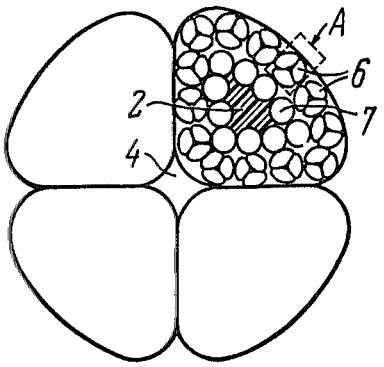
FIG. 3
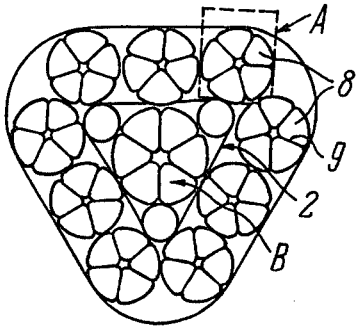
FIG. 5
FIG. 4
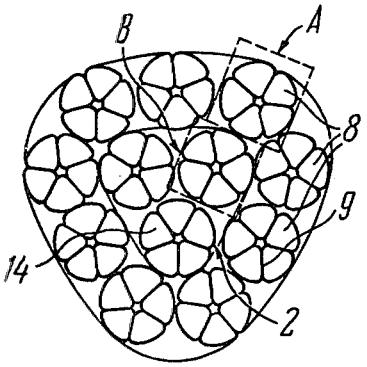
FIG. 6
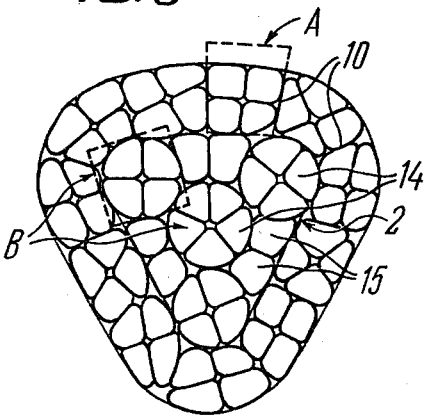

FLATTENED STRAND ROPE

FIELD OF THE INVENTION

The present invention relates to the field of rope manufacture and, more particularly, it relates to flattened strand ropes of metal wires, used in the various branches of industry. The present invention can be used to the maximum advantage in the various lifting mechanisms with large or small drum diameters.

BACKGROUND OF THE INVENTION

In many load-lifting mechanisms and systems, the lifting rope is expected to possess a combination of physically contradictory properties such as high flexibility and wear resistance. The former is attained through the use of a large number of thin wires while the latter calls for a small number of thick wires. Therefore, none of the prior art ropes are known to possess a combination of the foregoing properties.

Known in the art is a great number of structural varieties of flattened strand ropes and cables whose strands consist of round wires wound on a core (cf., German Patent No. 567,004, F.R.G. Patent No. 830,015, U.S. Pat. Nos. 2,018,461 and 3,457,718, U.S.S.R. Inventor's Certificates Nos. 89,792 and 500,305, etc.) or of non-round shaped wires wound on a core (cf., German Patent No. 656,123, U.S. Pat. No. 2,122,911, etc.).

While featuring an increased wear resistance, prior art flattened strand ropes have a high flexural rigidity. Because of this reason, they are mostly used in mines, lifting mechanisms and other systems utilizing pulley blocks and drums of large diameter. Attempts at using such ropes in lifting mechanisms having pulleys and drums of relatively small diameters revealed their inadequacy due to low efficiency. This can be attributed, mainly, to the fact that the flattened strand ropes, especially those of large diameters, require relatively thick and, consequently, less flexible wires (in comparison with the underlying layer wires) for forming the outer layer of strands. Moreover, large-size wires manufactured in the conventional manner have a lower ultimate strength than thin ones, which results in a lower summary tensile strength of the rope.

Wires in ropes of the former structural group, due to their round profile, are in contact with the adjacent wires in the layer over helical lines, thus leaving the strands with considerable spaces free of metal. Wires in the rope strands in the former structural group are subject to rapid wear. The tensile strength of the ropes as such is limited by a relatively low degree of filling the cross-sectional area of the strands with metal and by a relatively low strength of the wires due to the large size of the diameter.

The shaped profile of wires in ropes of the latter structural group makes for the contact of adjacent wires over helical surfaces, a high degree of wear resistance and a high degree of filling the strand cross-sectional area with metal and, at the same time, it results in a lower flexibility and the lowest possible wire strength, all other things equal, inasmuch as thick wires are required for making up rope strands of the latter structural group.

Therefore, prior art flattened strand rope structures fail to ensure the combination of high flexibility, wear resistance and strength in a single rope.

BRIEF DESCRIPTION OF THE INVENTION

It is an object of the present invention to eliminate the afore-listed disadvantages of prior art ropes.

It is the principal object of the invention to develop a flattened strand rope featuring a high flexibility combined with an adequately high wear resistance and strength.

In accordance with said and other objects of the present invention, in a flattened strand rope comprising one or several wedge-shaped strands made up of wires wound on a core, according to the present invention, at least part of wires in a strand are fashioned as twisted wire groups in which said wires are sector-shaped and in contact with each other over helical surfaces.

The execution of rope strands from wires, with at least a portion of the wires fashioned as groups, helps utilize thin and, consequently, stronger and more flexible wires. The sector shape of said wires makes for the maximum degree of filling the cross-sectional area of a group with metal, thereby increasing the strength thereof. All these features combined enable such a group of wires to function as a single wire of an equivalent cross-sectional area and higher strength. At the same time, such a group of wires features an increased flexibility inasmuch as wires incorporated in the group are capable of some shift relative each other upon the bending of the rope, whereas the combination in a single group of the sector shape and high strength results in an overall increase of the wear resistance of the rope and strands.

The invention is further characterized by that all of the wires in a strand comprise twisted wire groups in which the wires are sector-shaped and in contact with each other over helical surfaces.

It is expedient that the twisted wire groups should be arranged on the strand periphery, whereby thicker non-flexible low-strength wires can be replaced with the groups.

In some flattened strand rope structures it is possible to provide, between the twisted wire groups and the core, an intermediate layer of wires, the cross-sectional area of each of the latter wires being close in value to the cross-sectional area of wires making up the twisted wire groups, which helps attain a greater physical uniformity of the rope wires and, to a certain degree, render the conditions of their functioning in the strand and in the entire rope more uniform.

It is also expedient that the twisted wire strands be made up of equal amounts of like wires. This makes for the maximum facilitation of the manufacture of both groups and strands of the rope, for the provision of physically uniform wires and for the maximum uniformity of the conditions of functioning of the wire groups in the strands and in the entire rope.

It is expedient that the strand core should be likewise fashioned as at least one twisted wire group in which the wires are sector-shaped and in contact with each other over helical surface.

In accordance with the present invention, twisted wire groups in a strand are wedge-shaped in cross-section and in contact with each other over helical surfaces.

This helps, along with extending the surface of contact inside a group, extend the surface of contact between groups as well, this serving to increase the wear resistance of strands and of the entire rope, and attain the maximum degree of filling the strand cross-sectional area with metal.

It is further desirable that the wires incorporated in the twisted wire groups making up the strand layers and the core should have cross-sectional areas close in value to each other.

In some flattened strand rope structures, single wires can be located between twisted wire groups of a strand for increasing the degree of filling the strand cross-sectional area with metal. While so doing, the single wires may be shaped.

The present invention is further characterized in that, when making a single strand rope, according to the invention, it is wedge-shaped in cross-section, whereby the rope can be well matched with wedge-shaped grooves of pulleys and drums, to ensure a high traction coefficient in friction drives, high wear resistance and durability.

In this way, the herein disclosed flattened strand rope features, along with increased strength and wear resistance, a high flexibility, which results in a considerably prolonged service life and an expanded sphere of application, as well as providing for a possibility of manufacturing flattened strand ropes of larger diameters from wires of preset strength.

BRIEF DESCRIPTION OF DRAWINGS

The present invention is further illustrated with the following detailed description of a flattened strand rope according to the invention, reference being had to the accompanying drawings in which:

FIG. 3 shows schematically a flattened strand rope of four strands, each strand having an intermediate layer of single wires between the groups of wires arranged on the strand periphery and the core;

FIG. 4 is a schematic view of a strand of a rope, with a core made up of groups of wires;

FIG. 5 is similar to FIG. 4 but showing another core structure;

FIG. 6 is a schematic view of a strand of a rope, wherein a core is made up of groups of wires and single wires;

DETAILED DESCRIPTION OF THE INVENTION

Figure 1:
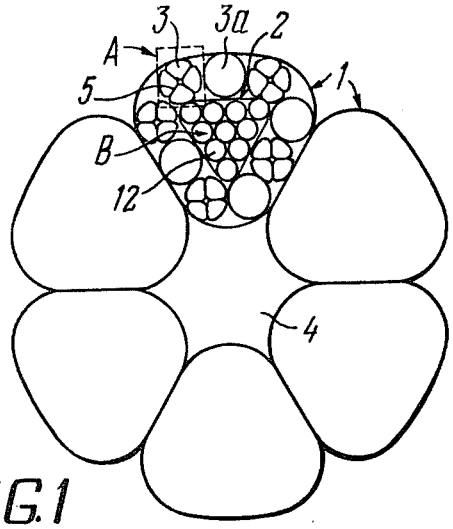
FIG. 1 is a schematic cross-sectional view of a flattened strand rope of the invention, made up of six identical strands whose structure is shown in cross-section of one of said strands.
Figure 2:
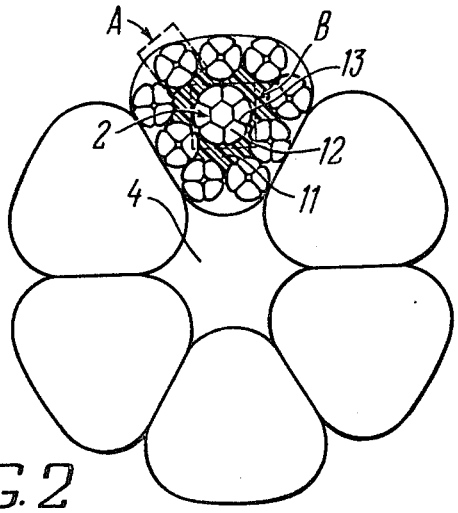
FIG. 2 is similar to FIG. 1 but showing another strand structure.

Referring now to the accompanying drawings, the herein disclosed flattened strand rope comprises several strands 1 as it is shown in FIGS. 1, 2, 3 or of one wedge-shaped strand as it is shown in FIGS. 4–8. Each of strand 1 is made up of wires 3 and 3*a* wound on a core 2, the cross-sectional area of the wires 3 being considerably less than that of the wires 3*a*.

The number of strands 1 in a rope may vary, as shown in FIGS. 1 and 3, and depends upon the specific purpose of the rope. For the sake of simplicity, the structure of one of the strands is shown in FIGS. 1–3, while the remaining strands are shown conventionally with closed contour lines.

A core may be placed in the rope center 4, made of any material, for example, of the same metal as the strand wires or of a metal softer than that of the strand wires 3 and 3*a*, of an organic or synthetic material. The core is not shown in FIG. 1 so as not to obscure the drawing, the core having no bearing on the subject matter of the invention.

Ropes containing a single strand 1 of any one of the structures shown in FIGS. 1–8 are wedge-shaped in cross-section whereby such ropes can be well matched with wedge-shaped grooves of pulleys and drums. Such wedge-shaped ropes are designed for use in diverse hoisting and conveying devices (hoisting devices in mines, elevators, ropeways, etc.). In so doing, any one of the strands 1 shown in FIGS. 4–8 can be used for making a flattened strand rope containing several strands.

The rope strands 1 can have a single layer, as shown in FIGS. 1 and 2, or they can have several, say, two layers of wires, as shown in FIG. 3.

In each strand 1 (FIG. 1) made up of the wires 3 and 3*a*, portions of the wires, for instance, the wires 3, are fashioned as twisted wire groups A, the cross-sectional area of the groups A of wires 3 is equal or close in value to that of the wires 3*a*.

The wires 3 in said groups A are made sector-shaped and having rectilinear portions 5 in the plane of the drawing, and are in contact with each other over helical surfaces because of the rectilinear portions 5.

In the case of a single-layer strand, the twisted wire groups A are arranged on the periphery of the strand 1 to form the outer layer thereof. In this case, the outer layer of a strand can be formed fully of the twisted wire groups A alone (FIGS. 2 and 4) having a uniform cross-sectional area, or it may comprise both the twisted wire groups A (FIG. 1) and single wires 3*a*, the cross-sectional area of the single wires 3*a* being equal or close in value to the cross-sectional area of the group A.

In case the strand 1 is formed of two layers (FIG. 3), the outer layer is formed by the twisted wire groups A alone consisting, say, of three wires 6, while an intermediate layer located between the twisted wire groups A and the core 2 is formed by single wires 7, the cross-sectional area of each one of the wires 7 being close in value to the cross-sectional area of the wires 6 incorporated in the twisted wire groups A.

In the rope shown in FIG. 4, all wires 8 of the strand 1 are presented as twisted wire groups A. In each one of the groups A, the wires 8 are made sector-shaped and have rectilinear portions 9 in the plane of the drawing and are in contact with each other over helical surfaces thanks to the rectilinear portions 9. In this case, the shape of the twisted wire groups A in cross-section can vary, for example, it can be close to circular (cf., FIGS. 1–4, 5, 7) or wedge-like such as trapezoidal (FIGS. 6 and 8) with rectilinear portions 10 in the plane of the drawing, as shown in FIG. 6. Such groups A in a strand are in contact with each other over helical surfaces, thanks to the rectilinear portions 10. It is preferred that the number of wires in each twisted wire group A should be the same for each strand in a single rope, say, three (FIG. 1), four (FIGS. 1, 2, 6, 7), five (FIGS. 4, 5), and so on, with the optimum number of wires in each group A depending upon the specific application of the rope.

The core 2 in each rope strand 1 can be of any conventional design and made of wires (FIG. 1) of the same or softer metal than the wires of the strand layers, of organic or synthetic material (FIG. 3).

Besides that, the strand core 2 may have an envelope 11 of metal, organic or synthetic material, as shown in FIG. 2.

To simplify the rope manufacturing process, as well as for producing a rope of more uniform composition, the strand core 2 can also be fashioned as a twisted wire group B, as shown in FIGS. 1 and 2, in which wires 12 have a round (FIG. 1), sector or some other shape (FIG. 2). In the core 2 having sector-shaped wires 12, said wires are in contact with each other over helical surfaces, thanks to rectilinear portions 13 of wires having the sector-shaped.

The core 2 can also be formed of a plurality of twisted wire groups B, as shown in FIGS. 4, 6, with wires 14 in each of said groups being sector-shaped and in contact with each other over helical surfaces.

As shown in FIGS. 4, 5, 6, 7, the twisted wire groups of the core 2 are round in cross-section, however, they can have any other shape.

Figure 8:
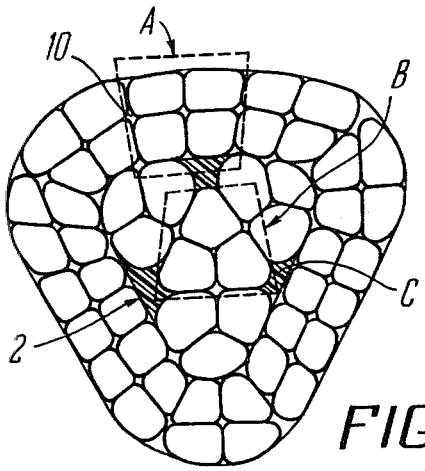
FIG. 8 is a schematic view of a strand of a rope, wherein a core is made up of wedge-shaped twisted wire groups.

For example, FIG. 8 illustrates a strand of a flattened strand rope wherein the core 2 comprises twisted wire groups B having a wedge (trihedral) shape in the plane of the drawing. Due to such shape, the groups B in the core 2 are in contact with each other and with the twisted wire groups A over helical surfaces. In this case, a filler C of synthetic or organic material can be placed in the core 2 between the groups B with a view to a more dense filling of the core cross-section.

The cross-sectional areas of the twisted wire groups A and B forming the layers of the strand 1 and the core 2, respectively, are close in value.

The twisted wire groups A in a strand are made up of equal amounts of like wires. This applies equally to the twisted wire groups B of the core 2. As shown in FIG. 4, a strand may include both groups A and B formed of equal amounts of like wires.

Figure 7:
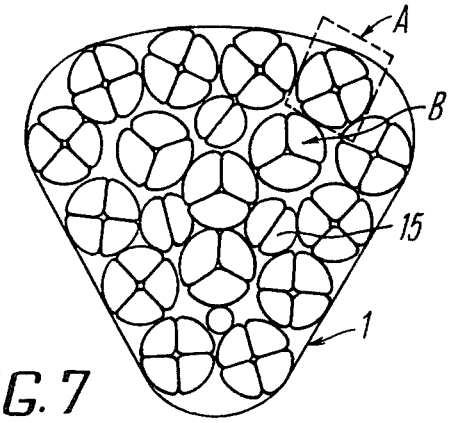
FIG. 7 is similar to FIG. 6, but showing another strand structure.

As shown in FIGS. 6 and 7, single round (not shown in the drawing) or shaped wires 15 are arranged between the twisted wire groups B (FIG. 6) of a strand core.

The herein disclosed flattened strand ropes, as shown in FIGS. 1 through 8, and strands thereof can be manufactured in any conventional manner using conventional means.

What is claimed is:

1. A rope comprising:
at least one wedge-shaped strand;
a core of said strands;
wires wound on said core to form said strand;
at least a portion of said strand wires fashioned as twisted wire groups;
the wires in each one of said twisted wire groups being made sector-shaped and in contact with each other over helical surfaces; and,
an intermediate layer of wires provided between said twisted wire groups of a strand and said core, the cross-sectional area of each one of said wires in said intermediate layer being close in value to the cross-sectional area of wires making up said twisted wire groups.

2. A rope comprising:
at least one wedge-shaped strand;
a core of said strands;
wires wound on said core to form said strand;
said strand wires being fashioned as twisted wire groups;
the wires in each one of said twisted wire groups being made sector-shaped and in contact with each other over helical surfaces;
an intermediate layer of wires provided between said twisted wire groups of a strand and said core.

3. A rope as claimed in claim 2, comprising one strand and, hence, having a wedge-shaped cross-section.

4. A rope as claimed in claim 2, wherein said wire groups in a strand are arranged on the periphery thereof.

5. A rope as claimed in claim 2, wherein said twisted wire groups in a strand are made up of equal amounts of like wires.

6. A flattened strand rope comprising:
several wedge-shaped strands wound on a central core;
a core of each said strand;
wires wound on said core of strand to form a strand;
at least portion of said strand wires fashioned as twisted wire groups;
the wires in each one of said twisted wire groups being made sector-shaped and in contact with each other over helical surfaces; and,
an intermediate layer of wires provided between said twisted wire groups of a strand and said core, the cross-sectional area of each one of said wires in said intermediate layer being close in value to the cross-sectional area of wires making up said twisted wire groups.

7. A flattened strand rope comprising:
several wedge-shaped strands wound on a central core;
a core of each one of said strands;
wires wound on said core of strand to form a strand;
said strand wires fashioned as twisted wire groups;
the wires in each one of said twisted wire groups being made sector-shaped and in contact with each other over helical surfaces; and,
an intermediate layer of wires provided between said twisted wire groups of a strand and said core.

8. A flattened strand rope as claimed in claim 7, wherein said twisted wire groups in a strand are arranged on the periphery thereof.

9. A flattened strand rope as claimed in claim 8, wherein the cross-sectional area of each one of said wires in said intermediate layer is close in value to the cross-sectional area of wires making up said twisted wire groups.

10. A flattened strand rope as claimed in claim 7, wherein said twisted wire groups in a strand are made up of equal amounts of like wires.

11. A flattened strand rope as claimed in claim 9, wherein said strand core is fashioned as at least one twisted wire group in which the wires are sector-shaped and in contact with each other over helical surface.

12. A flattened strand rope as claimed in claim 7, wherein the twisted wire groups in a strand are wedge-shaped in cross-section and in contact with each other over helical surfaces.

13. A flattened strand rope as claimed in claim 11, wherein the wires incorporated in said twisted wire groups making up said core and strand layers have cross-sectional areas close in value to each other.

14. A flattened strand rope as claimed in claim 13, wherein single wires are located between the twisted wire groups in a strand.

15. A flattened strand rope as claimed in claim 14, wherein said single wires are shaped wires.

* * * * *